US007059713B2

(12) United States Patent
Matsumoto et al.

(10) Patent No.: US 7,059,713 B2
(45) Date of Patent: Jun. 13, 2006

(54) INKJET PRINTING APPARATUS AND INK PRINTING METHOD

(75) Inventors: Nobuyuki Matsumoto, Tokyo (JP); Sadayuki Sugama, Ibaraki (JP); Mikio Sanada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 10/798,811

(22) Filed: Mar. 10, 2004

(65) Prior Publication Data

US 2005/0110857 A1 May 26, 2005

(30) Foreign Application Priority Data

Mar. 11, 2003 (JP) ..... 2003-065600
Feb. 20, 2004 (JP) ..... 2004-045384

(51) Int. Cl.
*B41J 2/01* (2006.01)
*B41J 11/08* (2006.01)

(52) U.S. Cl. ..... 347/104; 400/656

(58) Field of Classification Search ..... None
See application file for complete search history.

(56) References Cited

U.S. PATENT DOCUMENTS

| | | | | |
|---|---|---|---|---|
| 4,975,780 | A * | 12/1990 | Kuboki | 358/296 |
| 5,428,383 | A | 6/1995 | Shields et al. | |
| 5,488,402 | A | 1/1996 | Shields et al. | |
| 5,976,230 | A | 11/1999 | Askeland et al. | |
| 6,022,104 | A * | 2/2000 | Lin et al. | 347/102 |
| 2002/0041303 | A1 * | 4/2002 | Yoshinaga | 347/22 |

FOREIGN PATENT DOCUMENTS

| | | | |
|---|---|---|---|
| JP | 55-087564 | | 7/1980 |
| JP | 61-249755 | | 11/1986 |
| JP | 63-299971 | | 12/1988 |
| JP | 64-018669 | | 1/1989 |
| JP | 6-106841 | | 4/1994 |
| JP | 6-128514 | | 5/1994 |
| JP | 08-072227 | | 3/1996 |
| JP | 09295400 | A * | 11/1997 |
| JP | 10-309803 | | 11/1998 |
| JP | 11-334101 | | 12/1999 |
| JP | 11-343441 | | 12/1999 |
| JP | 2000-037890 | | 2/2000 |
| JP | 2000-062259 | | 2/2000 |
| JP | 2001-150652 | | 6/2001 |

(Continued)

OTHER PUBLICATIONS

Machine translation of JP 2002-103783 to Kusakabe from Japanese Patent Office website.*

(Continued)

*Primary Examiner*—Daniel J. Colilla
(74) *Attorney, Agent, or Firm*—Morgan & Finnegan, L.L.P.

(57) ABSTRACT

In an inkjet printing apparatus, when a printing is performed by generating the reacting so that, on the printing sheet, permeation of an ink solvent is delayed to prevent that the fixing time is prolonged thereby. A printing sheet is sucked by the comparatively weak suction force in a degree in which the sheet is tightly contacted with the pore of the platen. Hereby, insolubilized or coagulated coloring matters and the ink solvent except the reactive radical component or water on the sheet are sucked together into the sheet, and then the forcible permeation condition is formed. As a result, the fixing time is shorter than in a case where there is no suction, and the fixing by the reactive system ink-set can be accelerated.

17 Claims, 13 Drawing Sheets

FOREIGN PATENT DOCUMENTS

| | | | |
|---|---|---|---|
| JP | 2002103783 A | * | 4/2002 |
| JP | 2002-517341 | | 6/2002 |
| JP | 2003-048317 | | 2/2003 |
| WO | WO 99/64243 | | 12/1999 |

OTHER PUBLICATIONS

Machine translation of JP 9-295400 to Matsumoto from Japanese Patent Office website.*

* cited by examiner

INKJET PRINTING APPARATUS AND INK PRINTING METHOD

This application claims priority from Japanese Patent Application Nos. 2003-065600 filed Mar. 11, 2003 and 2004-045384 filed Feb. 20, 2004, which are incorporated hereinto by reference.

BACKGROUND OF THE INVENTION

1. Field of the Invention

The present invention relates to an inkjet printing apparatus and an inkjet printing method which perform a color printing by applying ink or a reacting liquid, which makes a coloring material in the ink insoluble or coagulated, to a printing sheet, which has an air permeability from an obverse side of the printing sheet to a reverse side thereof (excluding a medium having for example a resin coated layer and then having no air permeability), such as a plain paper, a printing sheet having an ink receiving layer, and a converted paper.

2. Description of the Related Art

Recently, in a field of an ink printing art, an ink jet printing method has been studied and put into practical use in place of conventional printing arts. The ink-jet printing method has various advantages such as a low noise, low running cost, and facts in which a size of the apparatus is easily reduced, and colorization is easy, and is widely used in a printer or copier.

When, by these inkjet printing apparatus, an image is printed on a printing sheet which is a so-called plain paper, a fine streak (hereinafter, called feathering) along a fiber of the sheet is generated in a process in which the ejected ink penetrates in the sheet, and hereby, there may be a case where the sharpness of a monochrome text and a color image printed is impaired. Further, in the case that a color image is printed, the bleeding by a fact in which the ink is mixed in the boundary portion between different colors, is caused, and becomes a cause by which the quality of the color image is lowered. These phenomena are conspicuously caused in the case where the high speed printing is conducted, because the permeability of the ink constitutes a cause of the phenomenon, and therefore, the compatibility of the high speed printing and the high image quality is made difficult.

In contrast to this, Japanese Patent Application Laid-open No. 61-249755(1986) discloses an art in which, in addition to printing ink, a liquid (hereinafter, also called reacting liquid) including a hardening agent for insolubilizing or coagulating the ink is previously ejected as a liquid droplet to a location on a printing sheet, on which location the printing ink is to be landed, and the printing ink is reacted on the printing sheet. The gazette also discloses an advantageous effect that, by the printing ink being reacted, the feathering or bleeding by the ejected ink on the sheet is prevented, and the lowering of the quality of the image or print is prevented.

Further, Japanese Patent Application Laid-open No. 6-128514(1994) discloses a means that does not use the reacting liquid but makes respective pH of the black and color ink different, and cause the viscosity of the ink to be increased in the boundary between the black area and the color area in the image to prevent the bleeding.

Furthermore, in the Japanese Patent Application Laid-open No. 6-106841(1994), Japanese Patent Application Laid-open No. 11-334101(1999), Japanese Patent Application Laid-open No. 11-343441(1999), U.S. Pat. No. 5,428,383, U.S. Pat. No. 5,488,402, and U.S. Pat. No. 5,976,230, an ink-set which is formed of the black ink and color ink, and an ink-set in which at least one of color ink shows the nature which reacts to the black ink, and the other ink does not react to the black ink, and an inkjet printing system by using this ink set, are described. Then, the structure of this ink-set can make the bleeding decreased. Particularly, in order to prevent the bleeding in a boundary between a printing area by the black ink and a printing area by the color ink which shows the no-reactivity to the black ink, the printing method (hereinafter, called "under printing") by which the printing of the color ink having the reactivity to the black ink is conducted on a printing area by the black ink in overlapping-manner, is disclosed.

As the black ink and the color ink which reacts the black ink used in the under printing, a combination of the black ink including a black coloring material having the hydrophilic radical and the reacting color ink including the reactive agent formed of metal ions, is known. When these inks are applied onto the printing sheet and mixed, and the hydrophilic radical is reacted to the metal ion, the black coloring material is caused to be insolubilized or coagulated. Hereby, it is prevented that the black coloring material moves to the printing area by the non-reactive color ink, which area adjoins the printing area by the black ink, and thus the bleeding generated between the printing area of the black ink and the printing area of the non-reactive color ink is decreased. Hereinafter, these ink-sets are called the reaction ink or reaction ink-set.

Any one of Japanese Patent Application Laid-open No. 61-249755(1986), Japanese Patent Application Laid-open No. 6-128514(1994), Japanese Patent Application Laid-open No. 6-106841(1994), Japanese Patent Application Laid-open No. 11-334101(1999), Japanese Patent Application Laid-open No. 11-343441(1999), U.S. Pat. No. 5,428,383, U.S. Pat. No. 5,488,402, and U.S. Pat. No. 5,976,230 shows a normal advantageous effect in the conventional art, which is brought by contacting liquid as droplets to each other at a boundary face to cause a desired reaction between the liquid droplets.

On the other hand, Japanese Patent Application Laid-open No. 2002-517341 discloses that the printing sheet for printing is applied with the reacting liquid over a whole surface by using a roller, which liquid is for example the liquid disclosed in Japanese Patent Application Laid-open No. 61-249755(1986), and then ink is ejected to the surface to perform printing.

It should be noted that Japanese Patent Application Laid-open No. 2000-062259 discloses sucking an air to attach a printing sheet for preventing the printing sheet from floating. Further, Japanese Patent Application Laid-open No. 10-309803(1998) discloses executing sucking on a reverse side of the printing sheet to accelerate permeation of the printing ink, in stead of using ink of high permeability.

However, a system disclosed in each of Japanese Patent Application Laid-open No. 61-249755(1986), Japanese Patent Application Laid-open No. 6-128514(1994), Japanese Patent Application Laid-open No. 6-106841(1994), Japanese Patent Application Laid-open No. 11-334101 (1999), Japanese Patent Application Laid-open No. 11-343441(1999), U.S. Pat. No. 5,428,383, U.S. Pat. No. 5,488,402, and U.S. Pat. No. 5,976,230 is that ejects ink to the printing sheet and causes the ink to be reacted to insolubilize a coloring material in the ink or to increase the viscosity of the ink. For this, when ink or a reactive group in the reacting liquid reacts, an insolubilized matter or a viscous matter stays on a surface of the printing sheet. Then, this insolubilized matter or the like causes unevenness in optical density of a printed image, and prevents in some degree that a solvent or water included in the ink permeates into the printing sheet. As the result, there is a problem that the drying time or fixing time of the ink ejected on the printing sheet is prolonged. Hereupon, this drying time or fixing time indicates a time of about 3 sec–20 sec, which is, after the printing, a time from the time in which the printing sheet is discharged, to the time in which the next printing sheet is ejected. Further, as to a judgment whether the ink on the sheet surface is fixed or not, for example, in the case where the printing sheet is further overlapped on the printed sheet, when the ink is not transferred onto the other sheet, it is judged that the ink is fixed. Further, this fixing time is different depending on the printing duty (the ink ejection amount per unit area) for the printing sheet.

Further, the printing method described in each of the above Japanese Patent Application Laid-open No. 61-249755(1986), Japanese Patent Application Laid-open No. 6-128514(1994), Japanese Patent Application Laid-open No. 6-106841(1994), Japanese Patent Application Laid-open No. 11-334101(1999), Japanese Patent Application Laid-open No. 11-343441(1999), U.S. Pat. No. 5,428,383, U.S. Pat. No. 5,488,402, and U.S. Pat. No. 5,976,230, in which the reacting liquid is used, generates the insolubilization or coagulation of the coloring material by the reaction of the ink with the reacting liquid. Since this insolubilized matter or the like hardly penetrates into the printing sheet, many of those insolubilized matter or the like is remained on the surface of the printing sheet. For this, there is a case where, when the printing surface is rubbed with the printing surface of the other sheet, many insolubilized matters or coagulated matters on the surface are physically taken off, thereby, the quality of a printed material is degraded. More specifically, when the reacting liquid is used, although the solidity of the image such as the rubbing resistance is more increased than a case of the printing in which the reacting liquid is not used and only the normal ink is used, as the result in which much of reacting liquid remain on the surface and the insolubilized matter is formed. Then, the rubbed and damaged amount is relatively increased. Further, since many of the insolubilized matter or the like stay on the surface of the printing sheet, there are many cases where a film formed with stayed insolubilized matter or the like becomes un-uniform, and as the result, there is, sometimes, also a case where the fluctuation of density is generated in the printed image. The inventors of this application have found out that the cause of the fluctuation of density is that much of the reacting liquid remains on the surface of the printing sheet, and is uneven distribution of the reacting liquid which is controlled by a condition of fibers in the printing sheet.

Furthermore, the inventors have found out that, even if the system for applying the reacting liquid by means of the roller applies the reacting liquid even on the printing sheet, the permeation of the reacting liquid may fluctuate at the surface of the printing sheet or at a layer near the surface, depending on the condition of the fibers in the printing sheet. Particularly, there may exist portions including no reacting liquid and portions including much more reacting liquid inside the printing sheet, irregularly. Further, as a result, the application of the coloring material is fluctuated according to the fluctuated distribution of the reacting liquid and thus unevenness in fixing the coloring material is caused. For this reason, the print density distribution becomes what is far removed from a desired distribution, and thus the print quality becomes degraded. On the other hand, in the case of applying great amount reacting liquid, the opposite effect that an image is formed only on the surface of the printing sheet may be caused and thus an image quality is noticeably degraded.

SUMMARY OF THE INVENTION

The present invention is made based on finding the new idea that the distribution of the reacting liquid especially inside the printing sheet is made even when applying smaller amount of the reacting liquid than the amount that can be absorbed by the printing sheet, and provides an inkjet printing apparatus and an ink jet printing method that can form an image with color ink at desired density and improve a fixing efficiency.

Further, the present invention solves a problem that caused by a condition of fibers in a printing sheet, in consideration of a conventional suction system which can not perform an even air suction for the printing sheet having the condition of fibers, and the object of the present invention is to provide an ink jet printing apparatus and an ink jet printing method which prevent a fixing time being lengthened, decrease in print quality due to an image being rubbed, and fluctuation in a print density.

In the first aspect of the present invention, there is provided an ink jet printing apparatus that uses a printing head and ejects ink from the printing head to a surface of a printing sheet, which has air permeability from an obverse side of the printing sheet to a reverse side of the printing sheet, the apparatus comprising:

transporting means for transporting the printing sheet relatively to the printing head;

reacting liquid applying means provided on a location along a transporting path of the transporting meads so as to apply a reacting liquid, which reacts with ink ejected to a face of the transported printing sheet from the printing head, to a whole area of the printing sheet; and suction means provided on a location along the transporting path of the transporting meads so as to apply a suction force on the transported printing sheet in a direction from the obverse side to the reverse side of the printing sheet in order to move the reacting liquid to an inside of the printing sheet.

In the second aspect of the present invention, there is provided an ink jet printing apparatus that performs printing with color ink on a printing sheet, which has air permeability from an obverse side of the printing sheet to a reverse side of the printing sheet, the apparatus comprising:

reacting liquid applying means for applying a reacting liquid, which reacts with the color ink, to a whole area of the printing sheet; and suction means for, at least before performing printing with the color ink, applying a suction force on the printing sheet in a direction from the obverse side to the reverse side of the printing sheet so as to move the reacting liquid to an inside of the printing sheet.

In the third aspect of the present invention, there is provided an ink printing method of performing printing with color ink on a printing sheet, which has air permeability from an obverse side of the printing sheet to a reverse side of the printing sheet, the method comprising:

a reacting liquid applying step for applying a reacting liquid, which reacts with the color ink, to a whole area of the printing sheet; and a suction step for, at least after the reacting liquid is applied to the printing sheet and before performing printing with the color ink, applying a suction force on the printing sheet in a direction from the obverse side to the reverse side of the printing sheet so as to move the reacting liquid to an inside of the printing sheet.

Here, a phrase "the reacting liquid is applied to a whole area of the printing sheet" indicates a condition of a printing sheet that a layer or a film of the reacting liquid is formed against an air, on the surface of the printing sheet or in an inside near the surface of the printing sheet, and then the layer or the like allows an air permeability between an obverse side of and a reverse side of the printing sheet to be substantially blocked. The present invention is featured in that unevenness of suction over a whole surface of the printing sheet, which occurs in a conventional suction system for conveying the printing sheet and for simply holding the printing sheet, is amended to be a uniform suction by applying the reacting liquid to the whole area of the printing sheet. As a result, uneven distribution of the reacting liquid, which depends on distributions of the fibers and air holes, is also resolved and then a higher quality image can be printed than that by the conventional art, comprehensively.

According to the above-described structure, since at least after the reacting liquid is applied to the whole area of the printing sheet and before printing is executed by using the color ink, a sucking air in a direction from the obverse side of the printing sheet to the reverse side of the same so as to move the reacting liquid into an inside of the printing sheet, for example solvents and water molecules constituting the ink and the reacting liquid are even diffused and permeated forcibly into the printing sheet by the air suction. Further, reactions generated by reacting of the ink with the reacting liquid or the reacting liquid itself can be forcibly permeated into the inside of a layer of the printing sheet.

As a result, the reacting between the ink and the reacting liquid can be promoted and become effective. Further, in the inkjet printing apparatus, when the printing is conducted by generating the reacting by which the penetration of the ink solvent is delayed on the printing sheet, it becomes possible to prevent that the fixing time is prolonged thereby.

Further, by the even diffusion of the reacting liquid by the suction, not only a case where the fixing of the reactive of the ink is stayed on the printing sheet surface, a case to make uniformly fixed in the vicinity of the printing sheet surface, becomes possible, and the increase of the solidity of the printing image and the increase of the image quality by the uniformity of the printing image are obtained.

It should be noted that embodiments of the present invention stated later dose not especially describe suction forces and structures for suction. However, for the present invention which can use a function of a suction device at a maximum, the ordinary person in the art can easily determine the suction force or the like with use of known devices. In the embodiments of the present invention, suction openings, distribution of the suction openings and the suction force are determined on the level in which normal printing sheets can be stably fed while the printing sheet is subjected to the suction.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
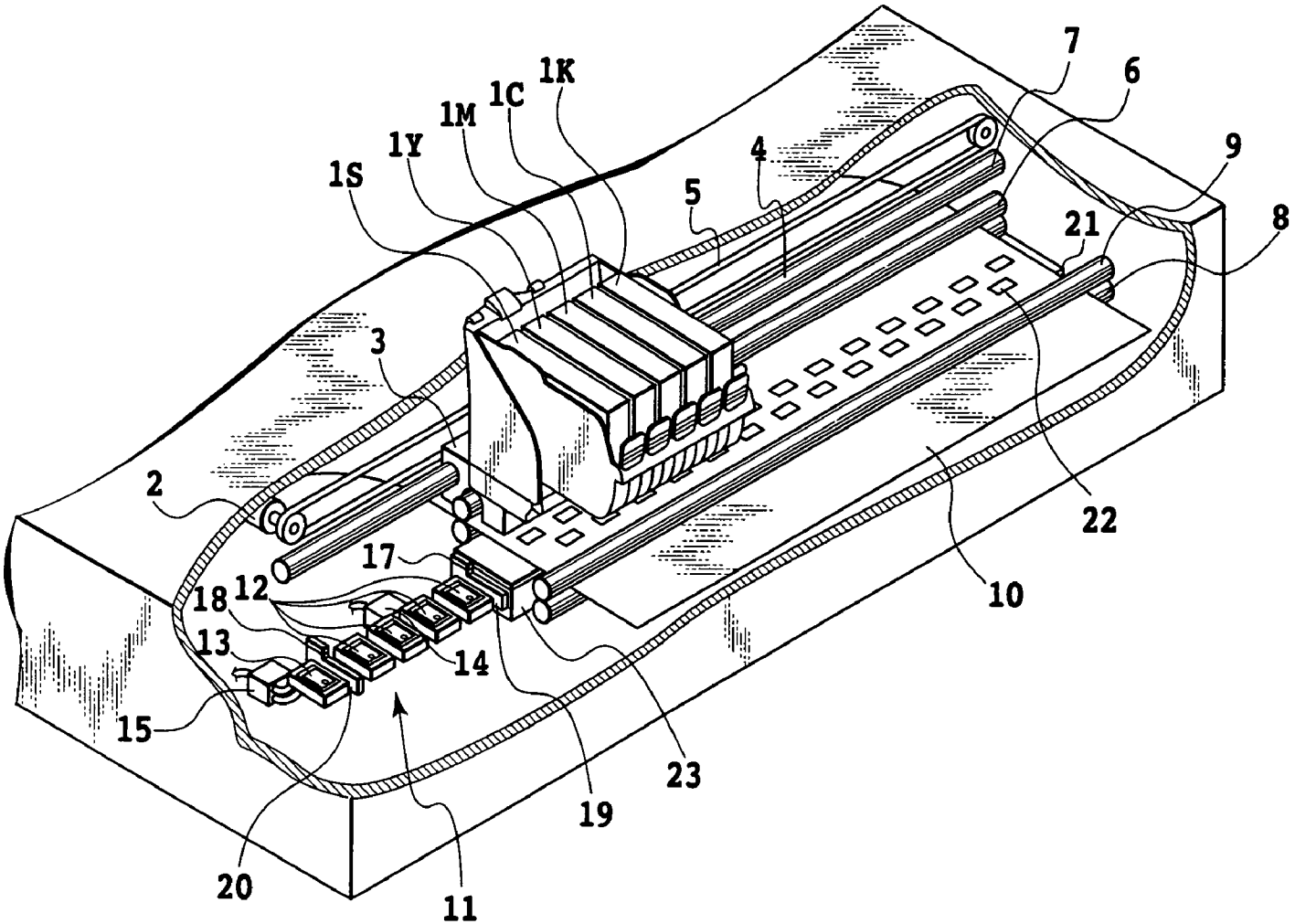
FIG. 1 is a perspective view showing an outline structure of an inkjet printer according to an embodiment of an inkjet printing apparatus of the present invention.

Referring to the drawings, the embodiment of the present invention will be described in detail below.

Embodiment 1

Figure 2A:
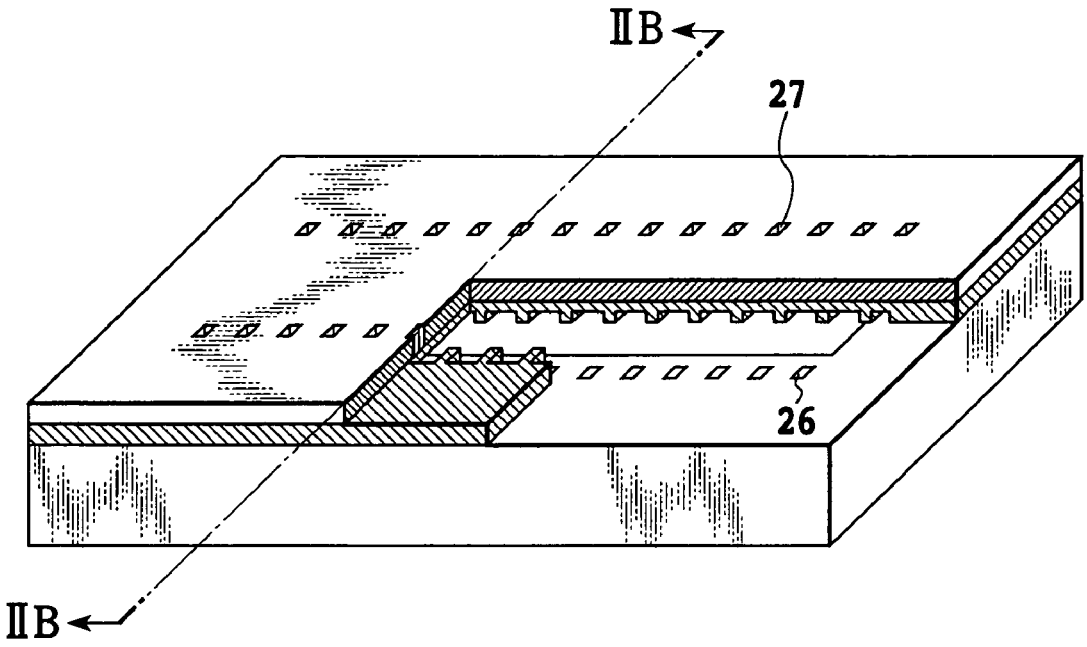
FIGS. 2A and 2B are views schematically showing a printing chip of a printing head which ejects one color ink in an inkjet printing head of the present embodiment.
Figure 2B:
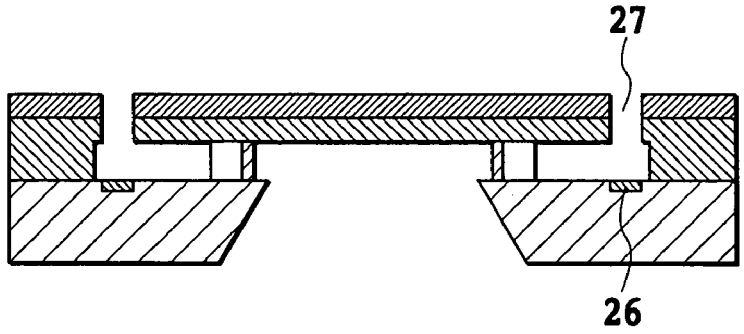
Figure 3:
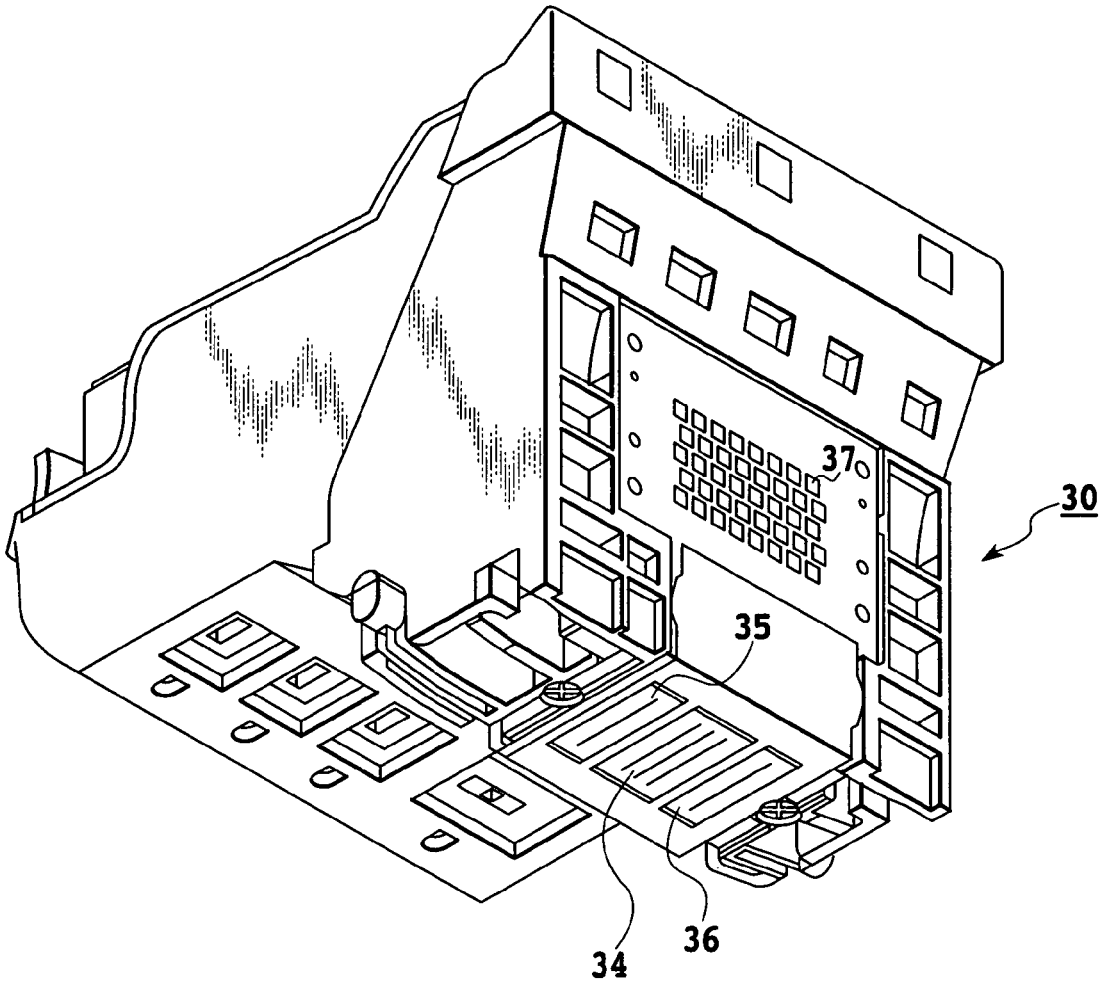
FIG. 3 is a perspective view showing a head cartridge structured by using the printing chip.

FIG. 1 is a perspective view showing an outline structure of an inkjet printer, according to an embodiment of an inkjet printing apparatus of the present invention, and FIGS. 2A, 2B and FIG. 3 are views for describing in detail the structure of the printing head used in this printer. Initially, this printing head will be described.

FIGS. 2A and 2B are views schematically showing an ejection opening structure (hereinafter, also called printing chip) of the printing head which ejects the ink of one color, in the inkjet printing head of the present embodiment, and FIG. 2A is its perspective view, and FIG. 2B is a view showing a sectional view of A–A' line in FIG. 2A.

As shown in these views, this printing chip is an ink ejection section of the inkjet printing head which ejects the ink, and an inkjet printing means for ejecting the ink by using the thermal energy. That is, it has an electric thermal converter 26 for generating the thermal energy, and the thermal energy generated by applying the electric pulse to the electric thermal converter 26 causes the film boiling to be generated in the ink, and the pressure change generated by the growth and contraction of a bubble by this film boiling is used to eject the ink from the ejection opening 27. In each of printing chips, the ejection opening 27 is provided in 2 rows, and these rows are provided in such a manner that a half of the ejection opening pitch of each row is relatively dislocated, and hereby, the ejection openings are arranged with the density of 1200 dpi (600 dpi per row) in whole 2 rows. Further, the electric thermal converters 26 are provided in the number and positions corresponding to these ejection openings. Then, in the serial type inkjet printing apparatus of the present embodiment, the printing chips shown in FIGS. 2A and 2B, are prepared for the number of colors of ink to be used, and the printing head is structured in such a manner that rows of ejection openings of each of printing chips are arranged so as to be respectively in parallel.

FIG. 3 is a perspective view showing a head cartridge structured by using printing chips in the above described manner. In the same view, a head cartridge 30 is formed by being provided with printing chips 34, 35, and 36, and as described in FIG. 1, it can be detachable to a carriage. The printing chip 34 in which, in each of printing chips constituting the head cartridge 30, three of the printing chips are integrally formed, is formed of the printing chip of each ink of C(Cyan), M (Magenta), and Y(Yellow), hereby, the color printing can be conducted. The printing chip 35 ejects K (Black) ink, and the printing chip 36 ejects the reacting liquid. The reacting liquid is the liquid including compound having the action to insolubilize or coagulate a coloring material such as a dye or pigment of each ink. Further, the reacting liquid improves a print quality. Here, the print quality includes increasing at least one of the density, saturation, degree of sharpness of the edge portion, dot shape, the printed image having good keeping such as water-resistance, and light-resistance.

FIG. 1 is a perspective view showing the structure of a main part of the inkjet printer of the present embodiment, under the situation that a part of cover is taken off.

In FIG. 1, on the carriage 3, the head cartridge 30 described in FIGS. 2A, 2B and FIG. 3, is detachably mounted. Then, on this cartridge 30, ink tanks of 1K, 1C, 1M, 1Y of 4 colors of K(black), C (cyan), M(magenta), and Y(yellow), and a tank 1S of the reacting liquid are detachably mounted. The ink is supplied to respective printing chips.

The inkjet printer of the present embodiment is structured in such a manner that, from the printing head provided with the printing chip 36, the reacting liquid for insolubilizing or coagulating a coloring material in the solvent such as water in the ink, is ejected onto the printing paper 10, hereby, the ink ejected from the printing head (printing chips 34, 35) of respective inks and the reacting liquid can be brought into contact with each other on the printing paper 10. Then, by this contact, the coloring material in the ink and the reacting liquid are reacted, and the coloring material in the ink can be insolubilized or coagulated on the printing sheet surface. As the result, the high density image printing, the prevention of the feathering or bleeding, or the increase of the water resistance of the image become possible. Hereupon, generally, when a dye is used as the coloring material, the insolubilizing is generated by the reacting with the reacting liquid. Further, when a pigment is used, the dispersion destroy of the pigment is generated and the coagulation is generated. Hereinafter, the substance generated by these insolubilizing or coagulation is also simply called insolubilized matter.

In the present embodiment, in addition to the above-described structure, the suction for the printing paper 10 is conducted through a pore 22 provided in a platen 21, as the detailed structure will be described later. By this suction, particularly, the ink solvent other than the insolubilized matters or water components can permeate rapidly in the paper 10. Further, the insolubilized matters can also permeate in a layer near the surface of the paper 10 in some degree. Hereby, the amount of the insolubilized matters stayed on the surface of the printing sheet can be reduced, and the increase of the rubbing resistance of the printed image or the suppression of the fluctuation of the density becomes possible. In other words, in the present embodiment, a suction force is determined in consideration of a relation between the printing sheet for use and the insolubilized matters to be generated, so that the insolubilized matters generated on the surface of the printing sheet can permeate into an inside of the layer near the surface. It should be noted that according to the present embodiment, the amount stayed on the surface is reduced, however, it is of course that the amount is larger than that in case compared to the case where the printing is conducted by only the ink in which the reacting liquid is not used. As a result, the effect such as, together with the increase of the rubbing resistance, the increase of the density by using the reacting liquid can also be obtained.

The carriage 3, when the driving force of a drive motor 2 is transmitted through a drive belt 5, can be reciprocally moved along a scan rail 4, and by the movement of the carriage 3, scanning of each printing head (printing chips 34, 35 and 36) onto the printing paper 10 can be performed. On the carriage 3 and the head cartridge 30 mounted on this, connectors (indicated by reference sign 37 in FIG. 3) for transmitting a signal to drive each printing head are provided, and through these connectors, the printing head for each ink can be electrically connected to an apparatus main body.

The scan rail 4 extends in the scan direction of the printing head and supports the carriage 3 so as to be slideable. Further, reference numerals 6, 7, and 8, 9 indicate transporting roller pair which are respectively arranged on the upstream side and the downstream side of the scan area by the printing head in the transporting path of the printing paper 10 and which conduct nip-transportation of the printing paper 10. The transporting roller pair 6, 7 functions as the sheet feed roller used for mainly supplying the printing paper 10, and the transporting roller pair 8, 9 functions as a sheet discharge roller for mainly discharging the sheet. The printing paper 10 as the printing sheet is guided and supported under the condition of the pressure contact with the platen 21 for regulating the printing surface flat, in a portion corresponding to its printing area. The platen 21 exists on the back side of the printing sheet, however, in this view, it is shown by a solid line for the simplification.

A face, on which the ejection opening of each printing head (each printing chip) which is mounted on the carriage 3 and scans is formed, is protruded downward from the carriage 3 and is positioned between the transporting roller pair 6, 7 and the sheet discharge rollers 8, 9. This face faces the printing paper 10, to which a suction force is applied through a plurality of pores 22 provided on the platen 21 and which is attracted by the platen 21. In the apparatus, on the lower side of the platen 21, a duct 23 forming the sealing system except the pores 22 is provided, and connected to a suction pump (not shown) of a recovery unit 11 through a rubber tube (not shown). This duct 23 is cylindrically formed of mold resin, or rubber or metal.

As will be described later, when the suction pump of the recovery unit 11 is rotated in a predetermined direction, the air is sucked through the pore 22 and the duct 23. Hereby, the solvent of the ink or water existing on the printing sheet surface to be transported is sucked into the inside of the printing sheet, and the forced permeation is conducted.

Hereupon, this suction force by the suction pump is controlled in such a manner that this suction force does not generate a large trouble in the transporting force by each transporting roller pair when the printing sheet is transported, and the accuracy of the feed amount of the transportation. Further, it is of course that the shape of the pore 22 opened in the platen 21 is not limited to that shown in the drawing. Further, its number is not limited to an example shown in the drawing. If the shape and the number of the pore are what generate a predetermined suction force as a whole, various shapes and numbers other than the zig-zag arrangement of the present embodiment may be formed.

Next, a detail of the structure of the recovery unit 11 including the suction pump will be described. In FIG. 1, in the moving area of the carriage 3, the recovery unit 11 is arranged in the vicinity of a home position set on left side separated from the printing area (scan area).

Figure 4:
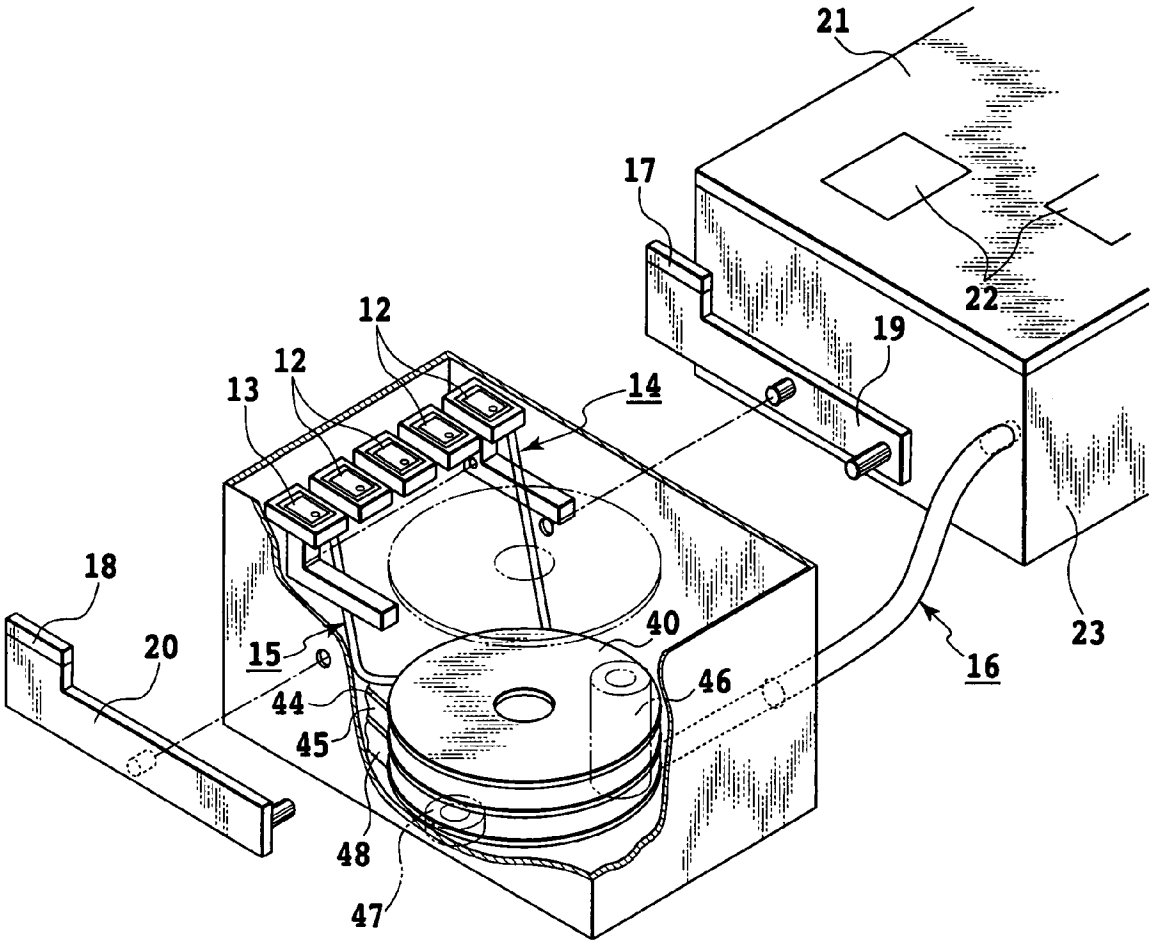
FIG. 4 is a view showing a detail of a recovery unit 11 shown in FIG. 1.

FIG. 4 is a view showing the detail of the recovery unit 11. In the recovery unit 11, 4 caps 12 corresponding to respective printing head chips 34, 35 of 4 color inks, and 1 cap 13 corresponding to 1 printing chip for the reacting liquid ejection are provided so that they can rise and fall in the upward and downward directions. Then, in the case where the carriage 3 is located in the home position, when the caps 12, 13 corresponding to the ejection opening forming surface of each printing chip are pressure-contacted, the ejection opening of each printing chip is covered (capping is conducted). By this capping, the evaporation of the solvent of the ink or water in the ejection opening is prevented, hereby, the increase of the viscosity or solidification of the ink is previously prevented. Further, the attaching of the dust to the ejection opening forming surface or the generation of bubble in the ink in the ejection opening is also prevented. By maintaining the ejection function in this manner, the generation of the ejection failure is previously prevented. Further, the recovery unit 11 has, as the suction pump, a tube pump 14 communicated to each cap 12 and a tube pump 15 communicated to the cap 13, and a tube pump 16 communicated to the platen 21. Tube pumps 14 and 15 generate the negative pressure in caps 12, 13 respectively under the capping condition, to the printing chip of K, C, M, Y ink or the printing chip of the reacting liquid, hereby, they are used for the suction and recovery processing by which the ink or reacting liquid is sucked and discharged from respective ejection openings. Tube pumps 14, 15 conduct the pump action by generating the negative pressure in the tube when tubes 44, 45 for respective pumps are held by a circular tube rail 40, and respective tubes are drawn by rotating the roller member 46. On the one hand, the tube pump 16 is provided with a tube 48 drawn by the roller 47 different from the roller 46, and the tube 48 is connected to a duct 23 integrated with the platen 21 in which the pore 22 for the sheet suction is opened. Hereby, when the roller 47 is rotated, in the same manner, the ink solvent or the like of the printing sheet can be sucked through the pore 22 opened in the platen 21.

Further, the recovery unit 11 is provided with 2 wiping members (blades) 17, 18 formed of elastic member such as rubber. The blade 17 is held by a blade holder 19, and the blade 18 is held by a blade holder 20. The blade holders 18, 19 are risen and fallen by the blade lifting mechanism (not shown) driven respectively by using the movement of the carriage 3, thereby, the blades 17, 18 rise and fall between a position (wiping position) protruded (risen) to wipe the ink affixed to the ejection opening forming face of each printing chip or the foreign matter, and a retreated (fallen) position (stand-by position) at which it is not brought into contact with the ejection opening forming surface. In this case, the blade 17 which conducts wiping the printing chip to eject each ink of K, C, M, Y, and the blade 18 which conducts wiping the printing chip to eject the reacting liquid are structured in such a manner that they can independently rise and fall. In blades 17, 18, when the carriage 3 moves from the right side in FIG. 1 (printing area side) to the home position side, or from the home position side to the print area side, the blade 17 is brought into contact with the ejection opening forming surface of each printing chip of K, C, M, Y ink, and the blade 18 is brought into contact with the ejection opening forming surface of the printing chip of the reacting liquid, and the wiping motion of those ejection opening forming surfaces is conducted by the relative movement. Hereby, each ink and the reacting liquid are mixed, and it is prevented that the insolubilized matters or coagulated matters are adhered to the blade or each ejection opening forming surface.

Hereupon, in the above described embodiment, the structure in which the pore 22 opened in the platen 21 is directly covered by the printing sheet, is shown. However, it can be structured in such a manner that the pore 22 is not directly covered by the printing sheet, for example, a mesh-like sheet is provided above the pore 22, and by this, the suction force through the pore 22 can apply also on other portions except the portion covering the pore 22 of the printing sheet. As a result, the suction force can be applied on the wider area of the printing sheet.

Next, the detail of the acceleration of the fixing by the suction for the printing sheet will be described.

Figure 5A:
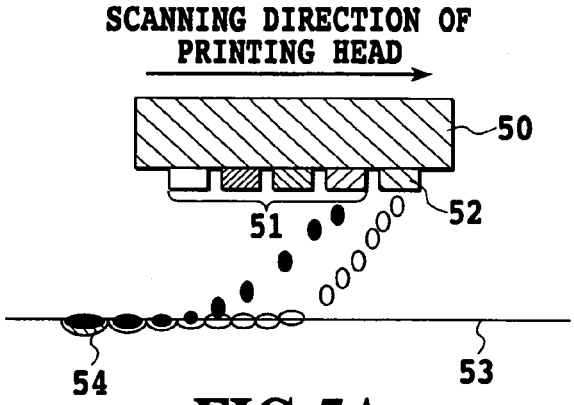
FIGS. 5A–5C are views for explaining the insolubilization or the coagulation of the reaction ink system, and the fixing acceleration at the time, in a printing sheet surface layer in an embodiment of the present invention.
Figure 5B:
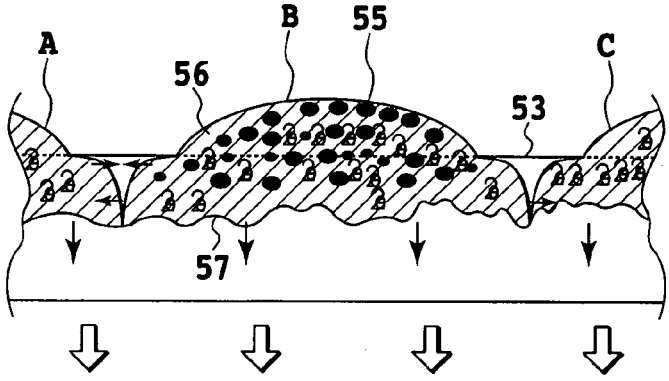
Figure 5C:
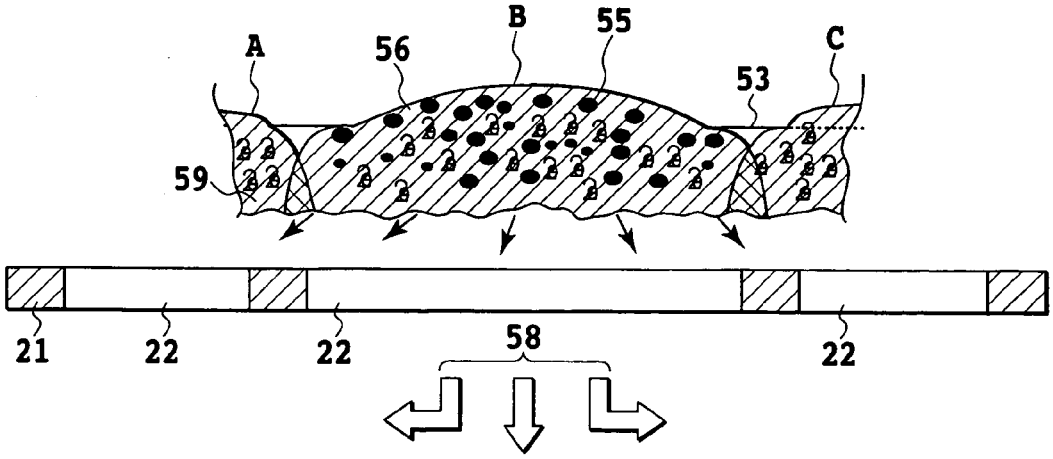

FIGS. 5A–5C are views explaining the insolubilization or coagulation of reacting ink system on the printing sheet surface and the layer near the surface, and the acceleration of fixing at that time when the insolubilization or the like occurs.

While the printing head 50 scans the printing paper 53 (printing sheet), corresponding to the printing data, each color ink of K, C, M, Y is ejected from respective printing chips 51, and the reacting liquid is ejected from the printing chip 52, which is capable of ejecting the reacting liquid to a whole area of the printing sheet, and ejects the reacting liquid at higher density and larger amount than that by the head chip 51. Hereby, on the surface layer of the printing sheet 53, corresponding to the printing data, the dye which is the coloring material of the ink and the reacting liquid are reacted. FIG. 5A is a view typically showing one example of that. FIG. 5A shows a state 54 that K (black) ink is ejected from the printing chip 51 and is landed on an area to which the reacting liquid, which is ejected from the printing chip 52, has been already landed, while the printing head 50 sans the printing sheet. Here, the reacting liquid is ejected so as to be landed on the whole area of the printing sheet. This "landing on the whole area" means, in the present embodiment, that an area factor is 100% for the surface of the printing sheet or for area inside layer near the surface and the reacting liquids are connected to each other over the whole surface of the printing sheet. Hereby, when the suction is applied to the printing sheet, the suction force is prevented from being applied unevenly, uneven application of the force being caused by using no reacting liquid.

FIG. 5B is a schematic enlarged view showing the above state 54, that is, the reaction state (one reaction state B within reaction states A, B, C as shown in FIG. 5B) between one ink droplet and the corresponding reacting liquid. This drawing shows that the reacting liquid and the ink are moved even inside the printing sheet by the suction and react with each other in connection with the move of the reacting liquid and the ink.

The embodiment of the present invention executes the suction which utilizes uneven distribution of fibers in the printing sheet. More specifically, pores existing between fibers that constitute the printing sheet are different in size and the force applied to the pores by the suction becomes greater at the smaller sized pore and becomes smaller at the larger sized pore. As a result of this, amounts of the reacting liquid and the ink move through the respective larger and smaller sized pores are substantially the same. Hereby, a uniform suction can be achieved to form even permeated state of the reacting liquid and the ink. This even permeation state means, in the present specification, more even permeation state than that in the conventional art without executing the suction for the printing sheet.

By the uniform suction described above, the reacting ink-set system causes the coloring materials in the ink to be moved with insolubilizated or coagulated and to be insolubilized coloring matters 55. Further, the ink solvent except the reacting radical component and water component 56 remained on the sheet surface permeate into the printing sheet. Reference numeral 57 shows the permeated state. It should be noted that in the fixing only by a permeation force which the ink has, the time necessary for the fixing is longer when it is compared to a case where the reacting liquid is not used and only the normal ink is used. This is for there as on that, as described above, the insolubilized coloring material 55 (insolubilized matters) covers the printing surface, and thus the permeation of the ink solvent is prevented in some degree. This fixing time is about 3 sec–20 sec, and it is of course that it is different depending on the used reacting liquid, kind of ink, or printing system.

FIG. 5C is a schematic view of the printing sheet surface layer of the state that the fixing acceleration by the suction is executed.

The movement of the reacting liquid and the ink described referring to FIG. 5B causes much of insolubilization to occur in the layer of the printing sheet. More specifically, the suction is executed with the comparatively weak suction force 58 of the magnitude in which the printing sheet 53 is tightly contacted with the pore 22 of the platen 21, or in which the insolubilized matters 55 can be uniformly diffused in the comparatively shallow layer in the vicinity of the surface of the printing sheet. Hereby, the insolubilized or coagulated coloring material 55 on the sheet surface and the ink solvent except the reacting radical component or water 56 are sucked together into the sheet, and the forcible permeation state 59 is formed. As a result, the fixing time is shorter than the condition in which there is no suction, and the fixing of the reacting ink-set system can be accelerated. Further, the insolubilized matters 55 can be uniformly diffused in the comparatively shallow layer in the vicinity of the surface of the printing sheet, and it becomes possible that the rubbing resistance of the printing image is increased, or the fluctuation of the density is suppressed. It should be noted that in boundaries between reacting units (respective boundaries between respective reacting units A, B and C in FIG. 5C), the reacting liquids tend to move to an adjacent area of reacting unit by the suction. However, these movements are prevented by mixing of the reacting liquids of the respective adjacent area of the units.

Then, when the motion described above is repeated, the fixing of the ink image formed on the printing sheet is completed at the time point at which the printing in the page of the printing sheet is completed. the speed-up of the printing apparatus in which the fixing time of the ink-set is not limited, can be achieved without a restriction due to fixing time such that a pause processing at the time of the continuous page printing, as seen in the printing apparatus in which fixing time is long, is abolished or reduced.

Embodiment 2

Next, the second embodiment of the present invention will be described. In the first embodiment, an example in which, during the suction, the suction force is constant and not changed, is described. That is, simultaneously with the time when the printing sheet is sucked, the suction force sucks the printing sheet by the suction force by which the ink solvent or water can be sucked. In contrast to this, in the present embodiment, the suction force changes in two steps, and it is determined that the suction force while the printing head scans the printing sheet and ejects the ink and reacting liquid onto the printing sheet, is weak, and after the scanning, the suction force up to the next scanning is stronger. Specifically, the suction force of the latter is made the same as that described in the first embodiment, and the permeation of the ink solvent is accelerated. Hereupon, because the structure of the printing chip, printing apparatus, recovery unit and the printing sheet suction is the same as the embodiment 1, the explanation is neglected.

When the suction force for the printing sheet in the present embodiment is described in detail, the comparatively weak suction force in a degree in which the printing sheet is tightly contacted with the platen 21 during the scanning by the printing head, and after the scanning by which, onto this sucked printing sheet, the ink and the reacting liquid are ejected from the printing head, the suction force by which the ink solvent component except the coloring material which is insolubilized or coagulated on the sheet surface, or water can be sucked on the sheet surface at the desired timing, are controlled by changing the rotation speed of the roller in the tube pump 16.

More specifically, while the printing head scans the printing sheet, the tube pump is controlled in such a manner that the suction force becomes a comparatively weak one of a degree in which the printing sheet is made tightly contacted with the platen, and after the printing head prints one scanning portion, between the time (ramp-down–ramp-up time) in which the braking to reverse the scanning direction for the next scanning and the acceleration when reverses it, are conducted, the printing sheet is sucked by the suction force stronger than that during the scanning, and the reacting component or the other ink solvent or water is sucked in the sheet. In this case, the line feed motion by which the printing sheet is transported by a predetermined amount, is also simultaneously conducted. When motions described above are repeated, the fixing of the ink on the printing sheet is completed at the time point at which the printing in one page of the printing sheet is completed.

Figure 6A:
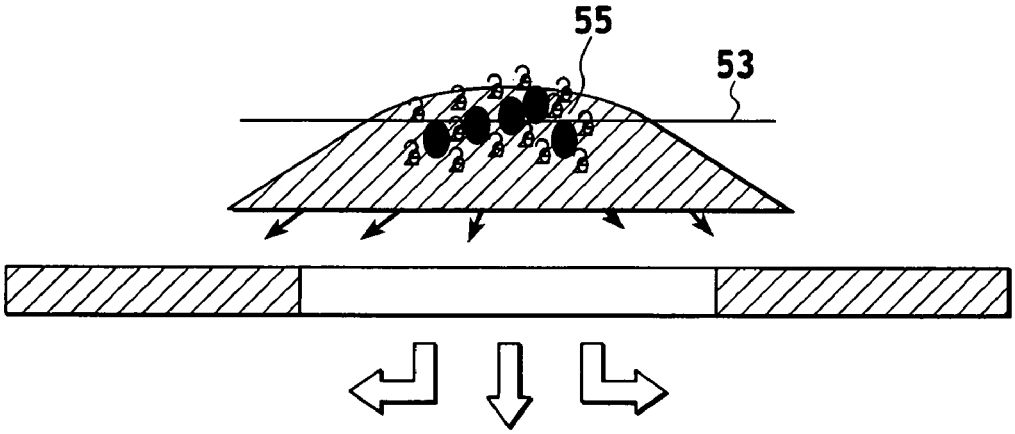
FIGS. 6A and 6B are views for explaining one of effects such as the fixing acceleration by another embodiment of the present invention.
Figure 6B:
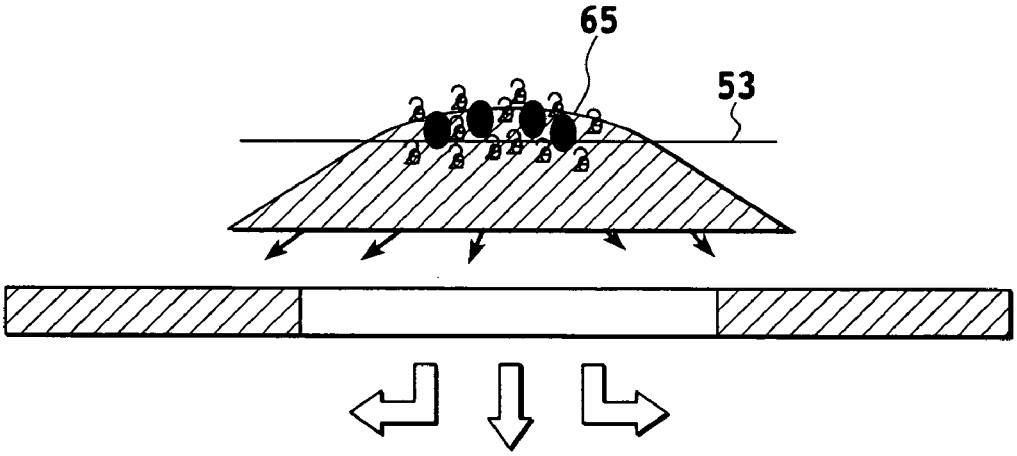

FIGS. 6A and 6B are views for explaining one of the effects of the fixing acceleration according to the present embodiment. FIG. 6B shows the insolubilized or coagulated ink coloring material 65 in the printing sheet surface layer in which the fixing acceleration according to the present embodiment is conducted. As can be seen from the same view, the insolubilized ink coloring materials (insolubilized matters) 65 remain more than that in the first embodiment on the printing sheet surface or in the shallow layer in the vicinity of the comparatively surface layer. In contrast to this, the coloring materials 55 shown in FIG. 6A which is the same as FIG. 5C shown relating to the Embodiment 1, permeates into a comparatively deep portion. This is for the reason in which, in the case of the present embodiment, because the sheet is sucked by the comparatively weak suction force when the ink lands on the printing sheet surface, at the time point at which the ink during this scanning is ejected, a case where the coloring material is permeated deep by the suction force is small.

That is, the present embodiment controls the suction force to be made two steps, and controls as to how much of the insolubilized material of the coloring material is remained in the layer in the vicinity of the surface of the printing sheet. Hereby, one of the effects as the increase of the optical density by using the reacting liquid, with the rubbing resistance or the suppression of the density fluctuation can be balanced.

Hereupon, for the suction by a plurality of steps of the suction force, it is not always necessary to conduct the suction during the ink ejection by the comparatively weak suction force, but in the application of the present invention, it may be allowable when the suction to penetrate the solvent is at least conducted.

Embodiment 3

The third embodiment of the present invention relates to the structure by which the sheet suction for the fixing acceleration is conducted at the position different from the scanning position by the printing head. The structure except for this suction position is substantially the same as the embodiments 1 and 2. However, a shape of the carriage and the printing head mounted on it is different (refer to FIG. 7).

Figure 7:
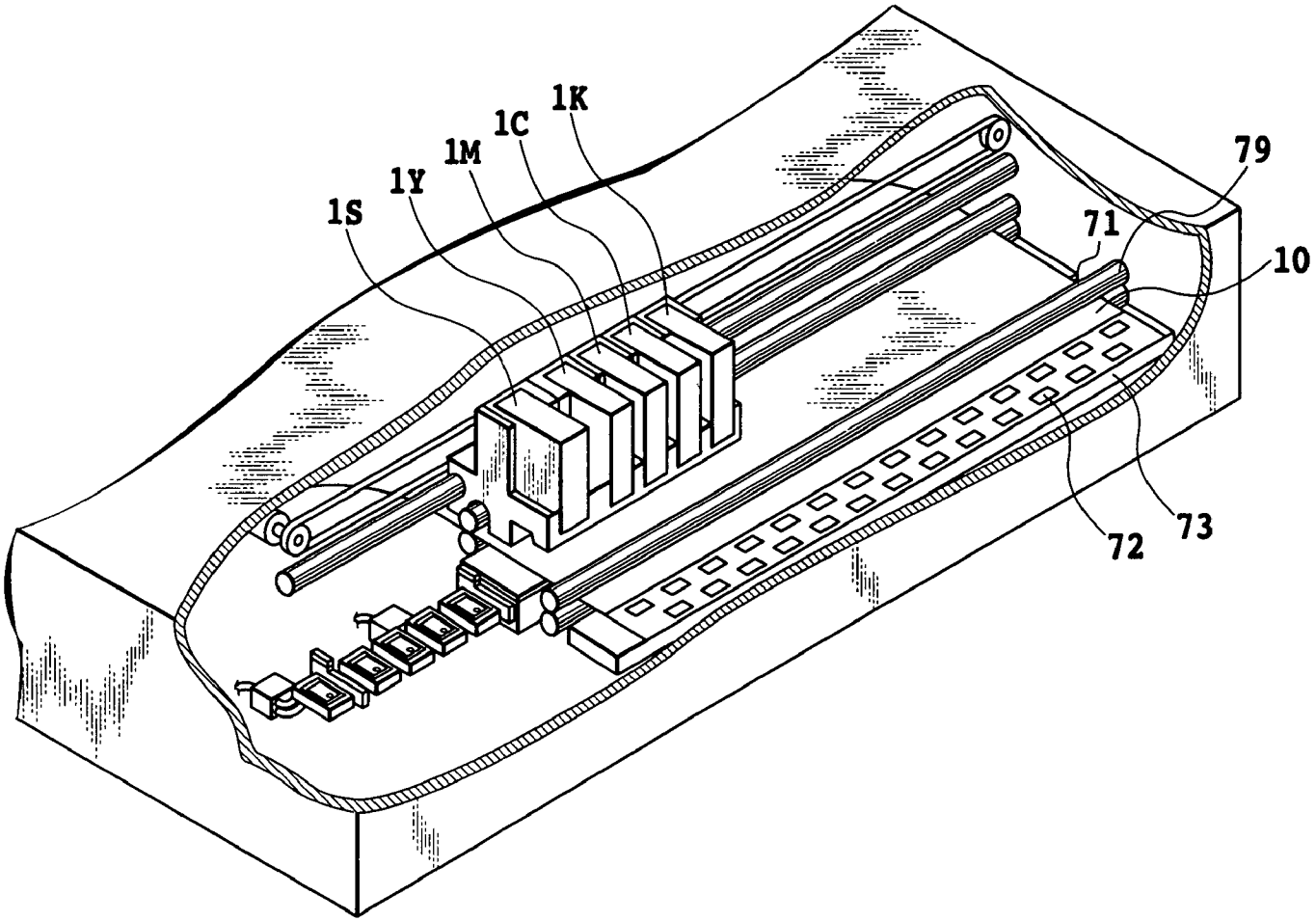
FIG. 7 is a view showing a main part structure of the inkjet printer according to yet another embodiment of the present invention.

FIG. 7 is a view showing the main structure of an ink-jet printer according to the present embodiment, and the same view as FIG. 1 shown relating to the embodiment 1. In the present embodiment, a pore for sucking the paper 10 is not provided in the platen 71, and the pore 72 is provided in the holding member for the fixing 73 positioned on the downstream side of the sheet discharge roller 79 on the sheet discharge side.

Next, the control of the fixing acceleration of the present embodiment will be described. In the case of the scanning by the printing head, the paper 10 is held by the platen 71 by which the sheet is not sucked, and the printing for one line (one scanning) is executed under this condition. When the printing for one line is completed, after the reversal of the scanning direction by the ramp down-up of the printing head, the paper 10 is subjected to a line feed. By this line feed, the printed area of the sheet having the insolubilized or coagulated coloring material thereon by the scanning before the line feed is transported on the hold member for fixing 73. Then, while the printing head scans the other area, the sheet is sucked through the pore 72 of the holding member for fixing 73. Hereby, the insolubilized matters on the sheet, the ink solvent except them, and water component are forcibly permeated into the sheet and the fixing is conducted. As this result, to a time period from the reacting of the ink with the reacting liquid on the sheet for the fixing, the time for the sheet line feed motion is added. The present embodiment can finely conduct the fixing acceleration even when the reaction speed of the ink used to the reacting liquid requires a several time.

Further, for example, when the permeability of the reacting liquid to be used is high, the ink and the reacting liquid permeate together in some degree into the layer of the printing sheet until the suction is conducted, and the insolubilization is generated in the layer. Then, there are many cases in which such an insolubilized matters in the layer is non-uniformly distributed. In the present embodiment, by conducting the suction to this, the insolubilized matters non-uniformly distributed in the layer of the printing sheet can be uniformly diffused.

Embodiment 4

In the present invention, an applying method of the reacting liquid is different from that in the embodiments 1–3. That is, in the embodiments 1–3, the reacting liquid is applied by ejecting the reacting liquid onto the printing sheet in the same manner as the ink by using the printing head. However, in the present embodiment, the reacting liquid is applied by using the roller.

Figure 8:
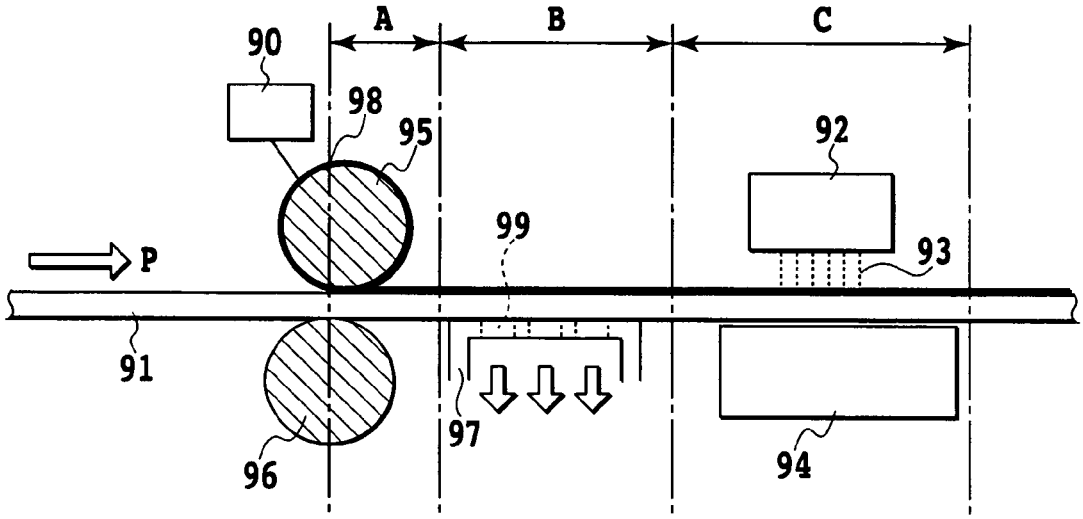
FIG. 8 is a view showing a main part structure of the inkjet printer according to yet another embodiment of the present invention.

FIG. 8 is a view schematically showing the outline structure of the inkjet printer according to the present embodiment.

In FIG. 8, reference numeral 91 designates the printing paper, and it is transported in the direction of an arrow P on the sheet transporting path. Along this transporting path, the printing area by the printing head 92 exists. In this printing area, the printing head 92 scans, in the same manner as in the embodiments 1–3, in the direction perpendicular to the transporting direction of the printing sheet 91, and during this scanning, the ink 93 is ejected on the printing sheet 91 so that the printing is performed. On the side facing the printing head 92 with the printing sheet 91 between them, the platen 94 for stably holding the printing sheet at the time of the printing ink ejection is provided.

Along the sheet transporting path, on the upstream side of the printing area by the printing head 92, a pair of a coating roller 95 for applying the reacting liquid and a transporting roller 96 facing the roller 95 with the printing sheet 91 between them is provided. The transporting roller 96 is rotated by the driving mechanism, not shown, and when the pressure force from the coating roller 95 is acted through the printing sheet 91 on the transporting roller 96, the printing sheet 91 can be transported. Accompanied to this transporting motion, the coating roller 95 coats the reacting liquid on the surface of the printing sheet 91 with which the roller contacts. That is, in the present embodiment, applying of the reacting liquid is executed in a section A shown in FIG. 8.

Specifically, the reacting liquid 98 almost uniformly supplied on the surface of the coating roller 95 from the storage tank 90 of the reacting liquid is transferred onto the surface of the printing sheet 91 to be transported under the state that it is flattened on the surface of the coating roller 95. Then, the reacting liquid transferred by the application of pressure of the coating roller 95 and the sheet transporting roller 96 is uniformly applied onto the printing sheet surface. Hereby, the reacting of the reacting liquid with the ink ejected from the printing head is uniformly conducted on the whole printing surface.

Figure 9A:
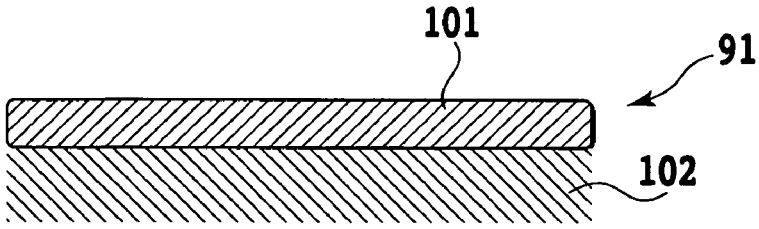
FIGS. 9A–9C are views for explaining the effect such as the fixing acceleration by the embodiment shown in FIG. 8.

FIG. 9A is a schematic view of the section of printing sheet showing a state of the applied reacting liquid to the printing sheet in the section A. As shown in the view, the reacting liquid 101 almost uniformly applied by the coating roller causes a permeation state 102 in the vicinity of the printing sheet surface layer, corresponding to the surface tension of the reacting liquid has.

Hereupon, in the present embodiment, it is of course that a roller rotated by the driving force is not the transporting roller 96 but the coating roller 95 may obtain the driving force to be rotated. In this case, the transporting roller functions as a roller which presses the printing sheet to the coating roller. Further, in FIG. 8, the structure such as other rollers (pinch roller, spur) necessary for stably holding the printing sheet at the time of printing, is neglected.

Further, regarding the structure in the present embodiment, by which the reacting liquid is almost uniformly supplied to the coating roller surface, it is not limited to the specific structure. For example, as described above, the structure possible in various forms such as the supply from the storage tank to the roller, or the supply from an absorption body into which the reacting liquid is soaked and stored, to the coating roller, may be appropriately selected.

Furthermore, the transfer structure of the reacting liquid onto the printing sheet by using the coating roller in the present embodiment, is not also limited to this. For example, various forms such as the structure by which the reacting liquid of the storage tank is flatly transferred onto the printing sheet by a rubber-like pallet, or the direct transfer onto the printing sheet from the absorption body into which the reacting liquid is soaked and stored, can be appropriately selected.

Next, in a section B shown in FIG. 8, the reacting liquid transferred onto the printing sheet is sucked. As shown in the same view, the printing sheet 91 to which the reacting liquid is almost uniformly applied is transported on the suction duct 97 provided with the pore 99 structuring the suction mechanism, on the upstream side of the printing area C by the printing head 92. In this transporting process, the suction which is the same as the each embodiment is performed.

Figure 9B:
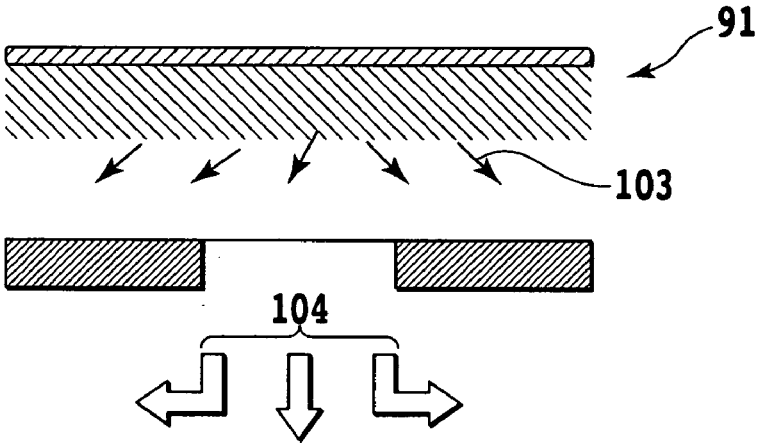

FIG. 9B is a schematic view of the section of the printing sheet showing a state of the applied reacting liquid to the printing sheet surface in the section B.

As shown in the view, when the suction 104 though the pore 99 of the suction duct 97 is performed, the permeation 103 in the inside of the layer of the printing sheet 91 is accelerated by the surface tension of the reacting liquid and the suction 104. Further, when the permeation is accelerated in this manner, the reacting radical of the reacting liquid is uniformly diffused from the printing sheet surface to the inside of the layer. After the permeation of the reacting liquid and the diffusion of the reaction radical in the vicinity of the surface of the printing sheet are accelerated in such manner, the printing sheet 91 is transported to the position for the printing head 92. Then, in the section C shown in FIG. 8, the ink 93 is ejected from the printing head 92 and lands on the surface of the printing sheet 91 into which the reacting liquid is permeated.

Figure 9C:
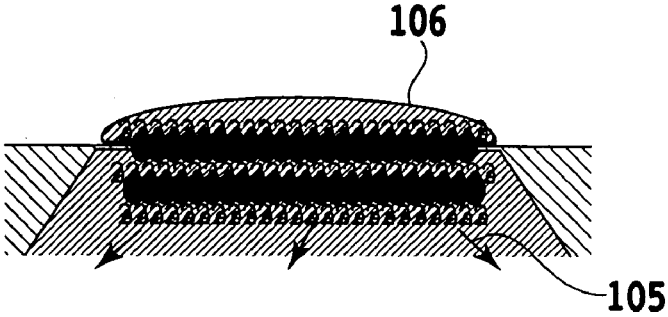

FIG. 9C is a schematic view of the section of the printing sheet when the ink 93 landed on the printing sheet 91 in the section C shown FIG. 8.

As shown in the same view, different from the first—the third embodiments, under the state that the ink is landed on the surface of the printing sheet, the reacting liquid is already diffused from the surface of the printing sheet to the inside of layer in the vicinity of the surface. In the present embodiment, because, by the reacting liquid previously permeated into the printing sheet inside, the printing sheet is wet to the inside of the printing sheet, the printing sheet is in easily wet condition to the ink, and the capillary force of the printing sheet itself is increased. Then, the ink landed on the printing sheet whose capillary force is increased, is reacted to the reactive radical of the reacting liquid which is diffused in a manner that the pores of the printing sheet is filled up with the reacting liquid by the help of the increase of the capillary force of the printing sheet itself, and generates the permeation condition 105 while causing the insolubilization or coagulation. In other words, in the present embodiment, the suction force for causing the reacting liquid on the surface of the printing sheet to be permeated into the inside of the layer near the surface is determined in consideration of the printing paper for use and the insolubilized matter to be generated.

Hereupon, in this permeation of the reacting liquid and the ink while being coagulated, as it is nearer the surface of the printing sheet, the concentration of the coloring material in the ink is higher, then the amount of the coloring material which is coagulated of insolubilized is greater. Also, as it advances from the surface to the layer inside the printing sheet, the coloring material amount in the ink is consumed for coagulation or the like, then the amount of the coloring material is decreased. In this process in which the ink is permeated, the reacting of the diffused reactive radical with the ink coloring material is uniformly caused not only on the surface of the printing sheet but also in the inside layer in the vicinity of the surface. Then, the insolubilized matters 106 of the coloring material is uniformly formed and this insolubilized matters become small as it advances from the surface to the inside of the sheet.

According to the present embodiment, the high speed fixing, in the same manner as in 1–3 embodiments, becomes possible, and because the uniform insolubilized matters are diffused in the inside layer in the vicinity of the surface of the sheet, the increase of the solidity such as the rubbing resistance of the printing material can be achieved. Further, the fluctuation of the printing density is also small, and the effect of the increase of the image quality (suppressing the unevenness of the density) can also be obtained.

Further, in the present embodiment, different from the first embodiment, because the reacting liquid ejection from the printing head is not necessary, the structure such as the printing apparatus recovery system for preventing the ink reacting in the vicinity of the ink ejection opening of the printing head, and the wiper member, can be simplified.

Figure 10:
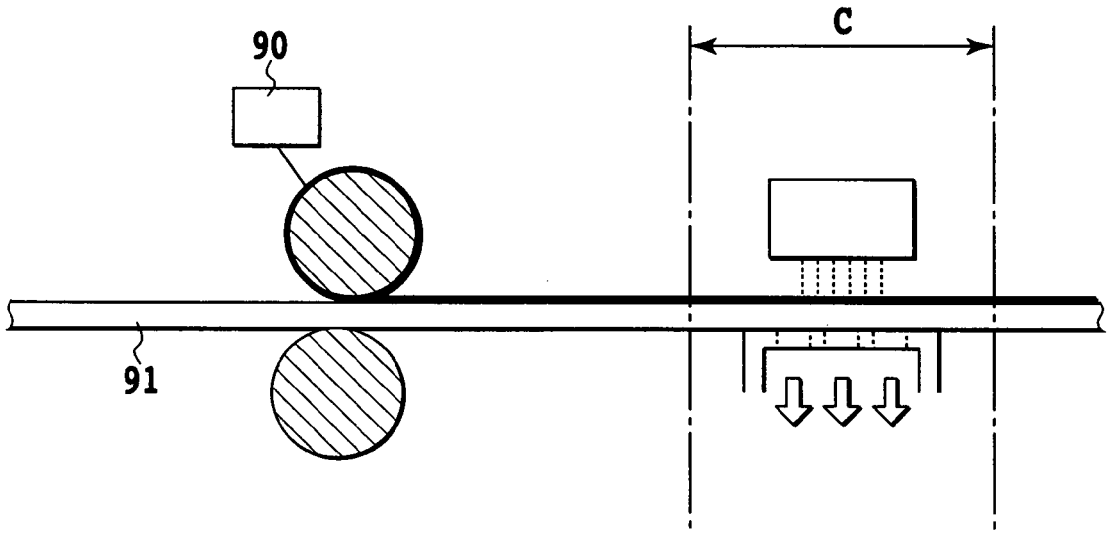
FIG. 10 is a view showing a main part structure of the inkjet printer according to yet another embodiment of the present invention.
Figure 11:
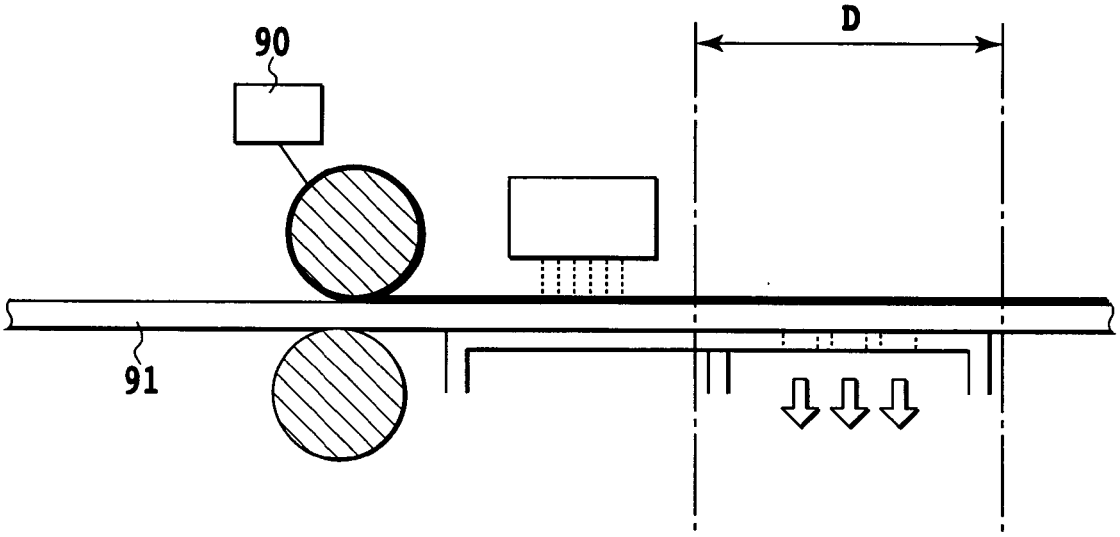
FIG. 11 is a view showing a main part structure of the inkjet printer according to yet another embodiment of the present invention.

Hereupon, in the present embodiment, the example in which the reacting liquid is applied and the suction process of the printing sheet is completed before the printing by use of the ink, is described. However, as shown in FIG. 10, in the same manner as the first embodiment, the suction may also be conducted at the time of printing by the ink in the section C. Further, as shown in FIG. 11, in the same manner as the third embodiment, the suction may also be conducted in the section D on the downstream side of the printing area. In this case, as described in the third embodiment, particularly, when the permeation property of the reacting liquid to be used is high, both of the ink and the reacting liquid permeate in some degree into the layer of the printing sheet before the suction is performed and the coagulation is generated in the layer. Then, there are many cases in which such insolubilized matters in the layer are non-uniformly distributed. However, since the suction is conducted on that, the insolubilized matters which are non-uniformly distributed in the layer of the printing sheet can be uniformly diffused.

What mode is selected can be selected, corresponding to the penetration speed performance into the printing sheet by the surface tension of the reacting liquid and the printing ink, and the performance of the fixing speed corresponding to the property of the printing sheet by the various conditions such as the pulp material of the printing sheet, surface processing condition (size degree), and pH.

Embodiment 5

In the embodiments 1–4, the suction force source is a source in which the pump for suction in the recovery unit is used. However, in the present embodiment, a suction apparatus separately provided from the pump of the recovery unit is used.

Figure 12:
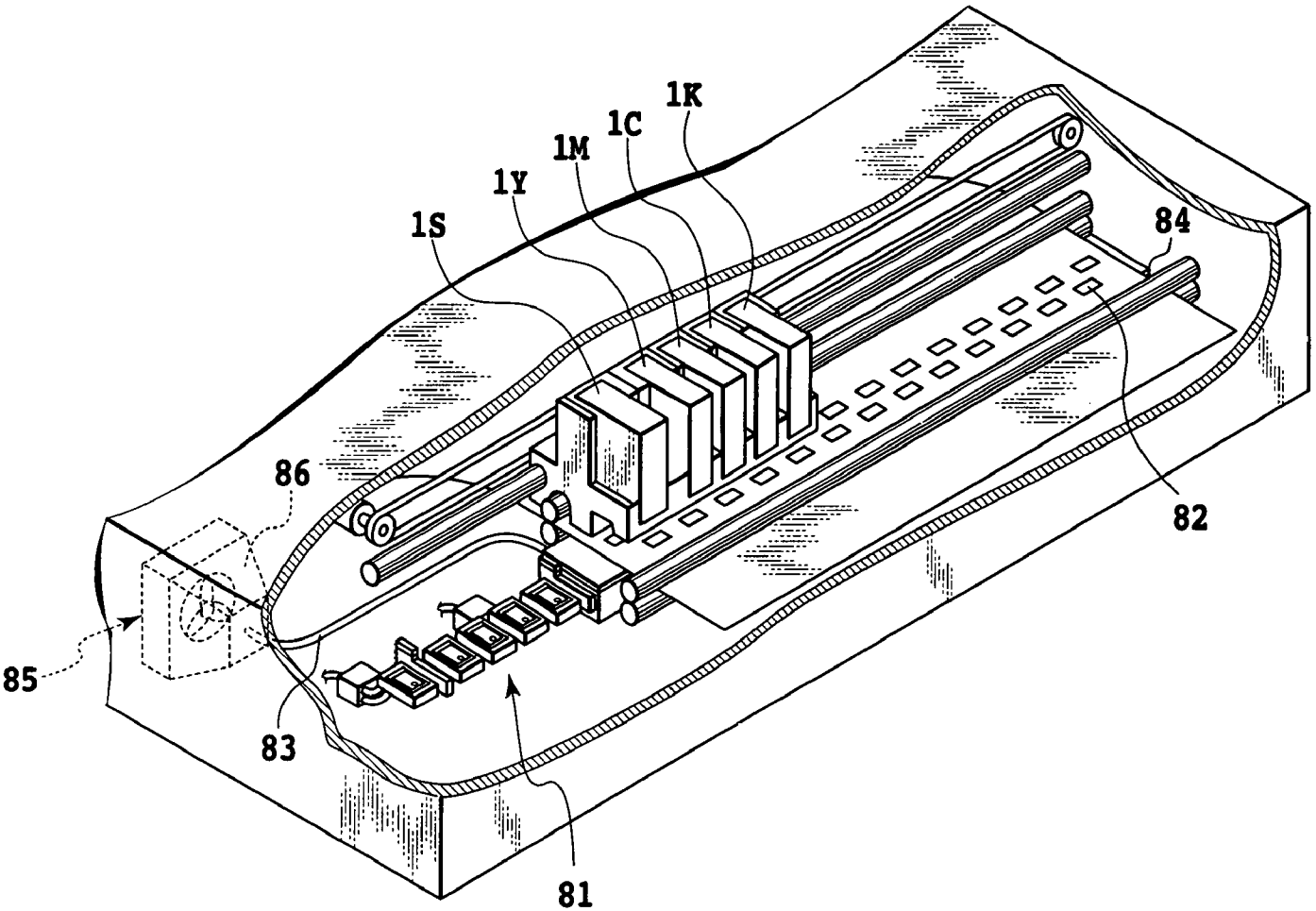
FIG. 12 is a view showing a main part structure of the inkjet printer according to yet another embodiment of the present invention.

FIG. 12 is a view showing a main part structure of the inkjet printer according to the present embodiment, and is the same view as FIG. 1 shown relating to Embodiment 1.

As shown in FIG. 12, as a separated apparatus from the recovery unit 81, a suction apparatus 85 by using a small type air fan is provided. Then, the suction apparatus 85 is connected to the platen 84 in which a plurality of pores 82 are provided, by the tube 83 and the duct 86 by which the air suction portion of the suction apparatus 85 is sealed. For the suction apparatus 85, when the suction force and the suction timing, described in Embodiment 1–3, can be controlled, the suction described in the each embodiment can be conducted.

Hereupon, as the suction apparatus, if it can generate the suction force to suck the air and the solvent in the printing sheet, an apparatus with any mechanism can also be used. The present embodiment is advantageous in the case where, in the comparatively long life inkjet printer, an increase of the durability of the pump for the suction in the recovery unit is difficult.

Embodiment 6

The present embodiment relates to a mode in which the suction for the printing sheet to which the reacting liquid is applied is performed in all sections A-B-C-D in the printing sheet transporting path from applying of the reacting liquid to the completion of the printing by the ink.

Figure 13:
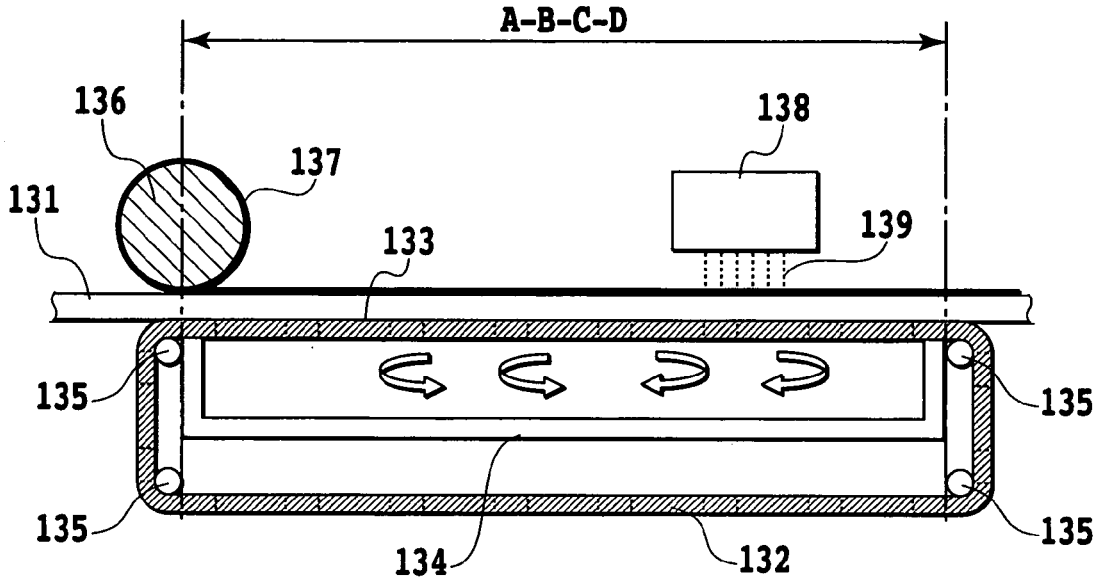
FIG. 13 is a view showing a main part structure of the inkjet printer according to yet another embodiment of the present invention.

FIG. 13 is a schematic view showing the printing sheet transporting path of the printing apparatus in the structure of the present embodiment by the section.

As shown in the view, largely different from FIGS. 8, 10, 11 according to the Embodiment 4, as the mechanism to transport the printing sheet 131, the roller is not used, but a transporting belt 132 is used. Then, to the transporting belt 132, the pore 133 for sucking is provided in a predetermined pattern. This transporting belt is provided in such a manner that it is brought into contact with the suction duct 134 on its rear side, and thus in the space which is practically sealed by the conveying belt 132 and the suction duct, the suction force by a suction mechanism (not shown) of the printing apparatus is acted, and the suction shown by an arrow in the view is performed.

Hereupon, a portion with which the transporting belt and the suction duct are in contact, is provided with, for example, the elastic member such as rubber, and the elastic member contacts with the belt while the elastic member is deformed in such a manner that it follows the movement of the conveying belt. Thus, the practically sealed space can be formed.

The drive of the transporting belt 132 is conducted when a part of the transporting rollers which are provided at 4 portions of the inside of the belt is rotated. Further, the transporting roller 135 provided left upper in the view, presses the printing sheet 131 to the coating roller 136 through the transporting belt 132. Hereby, the reacting liquid 137 supplied to the surface of the coating roller 136 is transferred onto the printing sheet.

In the transporting path of the printing sheet of the present embodiment, the printing sheet is sucked in all of the sections A-B-C-D showing a path from the process in which the reacting liquid 137 is applied to the printing sheet by the coating roller 136 to the image formation in which the printing ink 139 is ejected to the printing sheet from the printing head 138, and the conveying path after that.

In this manner, the sheet is sucked in almost all the process in the transporting path of the printing sheet, the image fixing by the performance of the reacting liquid and the ink, the density uniformity, and further, an increase of the rubbing resistance can be obtained. Further, it is effective in the structure of the high speed inkjet printer on which so-called full multi-head structured in such a manner that the printing heads are provided on all areas of the printing sheet width of the printing apparatus, is mounted.

Hereupon, in the each embodiment, an example in which the ink and the reacting liquid are used is described. However, as described above, the present invention can also be applied to a case where the reacting ink or the ink whose pH is different is used, and the insolubilized matters are respectively formed, or to also a case where the high viscosity ink is formed. That is, the solvent or water except the insolubilized matters or the ink whose viscosity is high is forcibly permeated as described above, and thus the fixing can be accelerated.

Further, it is of course that respective plurality of pores shown in FIG. 1 are arranged in the platen, in order to cover all of portions in which the printing of the transported printing sheet can be performed. That is, in FIG. 1, a plurality of pores are respectively separately provided, however, the arrangement of two rows of these pores covers all of the areas along the direction perpendicular to the conveying direction of the printing sheet.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus that uses a printing head and ejects ink from the printing head to a surface of a printing sheet, which has air permeability from an obverse side of the printing sheet to a reverse side of said printing sheet, said apparatus comprising:

transporting means for transporting the printing sheet relatively to the printing head;

reacting liquid applying means provided on a location along a transporting path of said transporting means so as to apply a reacting liquid, which reacts with ink ejected to a face of the transported printing sheet from the printing head, to a whole area of said printing sheet; and suction means provided on a location along the transporting path of said transporting means so as to apply a suction force on the transported printing sheet in a direction from the obverse side to the reverse side of said printing sheet in order to move the reacting liquid to an inside of the printing sheet, wherein the suction force applied by said suction means is determined so that a reacted product of the ink and the reacting liquid is uniformly distributed in an inside of a layer of the printing sheet.

2. An ink jet printing apparatus as claimed in claim 1, wherein said suction means changes a magnitude of the suction force so that a permeation state of the reacting liquid or a reacted product of the ink and the reacting liquid in the printing sheet is varied.

3. An ink jet printing apparatus as claimed in claim 1, wherein said reacting liquid applying means uses a printing head and eject the reactive liquid to the printing sheet from said printing head so as to apply the reactive liquid.

4. An ink jet printing apparatus as claimed in claim 1, wherein said reacting liquid applying means uses a coating roller for coating the reactive liquid to the printing sheet and coats the reacting liquid to the transported printing sheet while rotating the coating roller.

5. An ink jet printing apparatus as claimed in claim 1, wherein said suction means applies the suction force on the transported printing sheet after the reacting liquid is applied to the printing sheet and before the ink is ejected to said printing sheet.

6. An ink jet printing apparatus as claimed in claim 1, wherein said suction means applies the suction force on the transported printing sheet after the reacting liquid is applied to the printing sheet and while the ink is ejected to said printing sheet.

7. An ink jet printing apparatus as claimed in claim 1, wherein said suction means applies the suction force on the transported printing sheet after the reacting liquid is applied to the printing sheet and after the ink is ejected to said printing sheet.

8. An ink jet printing apparatus as claimed in claim 1, wherein said suction means applies the suction force on the transported printing sheet continuously from time when the reactive liquid is applied to the printing sheet to time after the ink is ejected to said printing sheet.

9. An ink jet printing apparatus as claimed in claim 1, wherein the reacting liquid is a liquid for insolubilizing or coagulating a coloring material in the ink.

10. An ink jet printing apparatus as claimed in claim 1, wherein the reacting liquid is color ink.

11. An ink jet printing apparatus as claimed in claim 1, wherein said suction means uses an air suction device used for recovery processing for the printing head.

12. An ink jet printing apparatus as claimed in claim 1, wherein said suction means controls the suction force correspondingly to an ejection timing in the printing head and a transporting timing of the printing sheet.

13. An ink jet printing apparatus that performs printing with color ink on a printing sheet, which has air permeability from an obverse side of the printing sheet to a reverse side of said printing sheet, said apparatus comprising:

reacting liquid applying means for applying a reacting liquid, which reacts with the color ink, to a whole area of the printing sheet; and suction means for, at least before performing printing with the color ink, applying a suction force on the printing sheet in a direction from the obverse side to the reverse side of said printing sheet so as to move the reacting liquid to an inside of the printing sheet, wherein the suction force applied by said suction means is determined so that a reacted product of the ink and the reacting liquid is uniformly distributed in an inside of a layer of the printing sheet.

14. An ink printing method of performing printing with color ink on a printing sheet, which has air permeability from an obverse side of the printing sheet to a reverse side of said printing sheet, said method comprising:

a reacting liquid applying step for applying a reacting liquid, which reacts with the color ink, to a whole area of the printing sheet; and a suction step for, at least after the reacting liquid is applied to the printing sheet and before performing printing with the color ink, applying a suction force on the printing sheet in a direction from the obverse side to the reverse side of said printing sheet so as to move the reacting liquid to an inside of the printing sheet, wherein the suction force applied in said suction step is determined so that a reacted product of the ink and the reacting liquid is uniformly distributed in an inside of a layer of the printing sheet.

15. An ink printing method as claimed in claim 14, further comprising a suction step for applying a suction force on the printing sheet while performing printing with the color ink.

16. An ink printing method as claimed in claim 14, wherein said reacting liquid applying step applies the reacting liquid as a droplet to the printing sheet to supply the reacting liquid to a whole area of the printing sheet by permeation, before performing printing with the color ink.

17. An ink printing method as claimed in claim 14, wherein said reacting liquid applying step coats the reacting liquid to the printing sheet through a surface of a rolling body to supply the reacting liquid to a whole area of the printing sheet by permeation.

* * * * *